US007891657B2

(12) United States Patent
Fujita

(10) Patent No.: US 7,891,657 B2
(45) Date of Patent: Feb. 22, 2011

(54) SHEET FEEDER, IMAGE FORMING APPARATUS, AND SHEET FEEDING METHOD, UTILIZING SHEET DEFORMATION PREVENTION MEMBER

(75) Inventor: Akihiro Fujita, Isehara (JP)

(73) Assignee: Ricoh Company, Ltd., Tokyo (JP)

( * ) Notice: Subject to any disclaimer, the term of this patent is extended or adjusted under 35 U.S.C. 154(b) by 261 days.

(21) Appl. No.: 11/937,783

(22) Filed: Nov. 9, 2007

(65) Prior Publication Data

US 2008/0122161 A1 May 29, 2008

(30) Foreign Application Priority Data

Nov. 29, 2006 (JP) ..... 2006-322264

(51) Int. Cl.
*B65H 3/52* (2006.01)

(52) U.S. Cl. ..... 271/121; 271/114; 271/265.01

(58) Field of Classification Search ..... 271/121, 271/114, 265.01
See application file for complete search history.

(56) References Cited

U.S. PATENT DOCUMENTS 5,884,860 A 3/1999 Ishikawa et al.
6,079,708 A 6/2000 Fujita
6,234,470 B1 * 5/2001 Okitsu et al. ..... 271/114
2005/0012969 A1 * 1/2005 Matsuyama et al. ..... 358/498
2005/0253323 A1 11/2005 Fujita et al.
2006/0180990 A1 * 8/2006 Ueda et al. ..... 271/121

FOREIGN PATENT DOCUMENTS

JP 3-256938 11/1991
JP 03256938 A * 11/1991
JP 5-328056 12/1993
JP 2002-240971 8/2002
JP 3452118 7/2003
JP 2004-99280 4/2004
JP 3665765 4/2005

OTHER PUBLICATIONS

U.S. Appl. No. 09/163,328, filed Sep. 30, 1998.

* cited by examiner

*Primary Examiner*—Stefanos Karmis
*Assistant Examiner*—Gerald W McClain
(74) *Attorney, Agent, or Firm*—Cooper & Dunham LLP

(57) ABSTRACT

A sheet feeder includes a sheet tray, a feed roller, a separating pad, a feed motor, a conveying roller pair, and a deformation prevention member. The feed roller picks up and feeds first and second sheets from the sheet tray. The separating pad separates the first sheet from the second sheet together with the feed roller. The deformation prevention member is provided to prevent deformation of a head of the second sheet caused by the feed roller and the separating pad nipping the second sheet.

19 Claims, 10 Drawing Sheets

SHEET FEEDER, IMAGE FORMING APPARATUS, AND SHEET FEEDING METHOD, UTILIZING SHEET DEFORMATION PREVENTION MEMBER

BACKGROUND

1. Field

The present specification describes a sheet feeder, an image forming apparatus, and a sheet feeding method, and more particularly, a sheet feeder, an image forming apparatus, and a sheet feeding method for feeding sheets using a sheet feeder to feed the sheets to an image forming apparatus.

2. Description of the Background

An image forming apparatus, such as a copying machine, a printer, a facsimile machine, a plotter, or a multifunction printer having two or more of copying, printing, scanning, and facsimile functions, forms an image on a recording medium (e.g., a sheet). A sheet feeder feeds sheets from a paper tray one by one to an image forming device, and the image forming device forms an image on a sheet. When sheets are fed from the paper tray, one sheet is separated from the other sheets by using a separating nail or a separating pad before being sent to the image forming device.

In a sheet feeder using the separating nail, a head corner of sheets loaded in the paper tray is engaged with the separating nail. A feed roller is provided downstream from the separating nail in a sheet conveyance direction. When the feed roller rotates, an uppermost sheet of the sheets loaded in the paper tray is warped at a position between the separating nail and the feed roller. When the uppermost sheet is warped to a limit, the uppermost sheet springs and separates from the other sheets loaded in the paper tray, and is fed toward the image forming device.

In a sheet feeder using the separating pad, the rotating feed roller and the separating pad nip sheets. A friction coefficient between the feed roller and a sheet is greater than a friction coefficient between the separating pad and the sheet. The friction coefficient between the separating pad and the sheet is greater than a friction coefficient between sheets. Thus, the feed roller and the separating pad separate an uppermost sheet from the other sheets, and feed the uppermost sheet toward the image forming device.

In one exemplary sheet feeder using the separating nail, a semicircular feed roller feeds an uppermost sheet from a paper tray. The separating nail (e.g., a lever) separates the uppermost sheet from a next sheet and returns the next sheet to the paper tray.

However, when the separating nail contacts a head of the next sheet to return the next sheet to the paper tray, the separating nail may curl or damage the head of the next sheet. In addition, the separating nail returns to an original position each time the separating nail separates an uppermost sheet from a next sheet. Consequently, when sheets are continuously fed, the sheets may not be fed quickly.

In another exemplary sheet feeder using the separating pad, a feed roller is attached to a feed roller shaft. The feed roller shaft rotatably supports a cam unit. One rotation of the cam unit causes a sheet placed on a bottom plate of a paper tray to contact the feed roller and causes the separating pad to contact the feed roller, so as to feed the sheet. Specifically, the single feed roller picks up a first sheet from the paper tray and separates the first sheet from a second sheet in the paper tray. Therefore, when sheets are continuously fed from the paper tray, the feed roller rotated by the first sheet feeds the second sheet. Thus, the second sheet is stopped at a nip formed between the feed roller and the separating pad in a state such that the feed roller and the separating pad nip a head of the second sheet, until a next feeding job starts. However, when the feed roller and the separating pad nip the second sheet for an extended period of time, the head of the second sheet may curl. This curl may present a problem like the following.

An image forming apparatus may include an image forming device including a recording head for discharging drops of ink onto a sheet conveyed on a conveyer to form an image on the sheet. A small gap of only about 1.3 mm is provided between the recording head and the sheet on the conveyer, and therefore, when the sheet is curled in the sheet feeder, the sheet may come into contact with the recording head. As a result, the recording head may not properly discharge an ink drop onto the sheet, resulting in formation of a faulty image.

SUMMARY

This patent specification describes a novel sheet feeder. One example of a novel sheet feeder includes a sheet tray, a feed roller, a separating pad, a feed motor, a conveying roller pair, and a deformation prevention member. The sheet tray is configured to load sheets including first and second sheets. The feed roller is configured to pick up and feed the first and second sheets. The separating pad is configured to separate the first sheet from the second sheet together with the feed roller. The feed motor is configured to drive the feed roller. The conveying roller pair is provided downstream from the feed roller in a sheet conveyance direction, and is configured to feed the first sheet fed by the feed roller. The deformation prevention member is configured to prevent deformation of a head of the second sheet caused by the feed roller and the separating pad nipping the second sheet.

This patent specification further describes a novel image forming apparatus. One example of a novel image forming apparatus includes a sheet feeder configured to feed a sheet. The sheet feeder includes a sheet tray, a feed roller, a separating pad, a feed motor, a conveying roller pair, and a deformation prevention member. The sheet tray is configured to load sheets including first and second sheets. The feed roller is configured to pick up and feed the first and second sheets. The separating pad is configured to separate the first sheet from the second sheet together with the feed roller. The feed motor is configured to drive the feed roller. The conveying roller pair is provided downstream from the feed roller in a sheet conveyance direction, and is configured to feed the first sheet fed by the feed roller. The deformation prevention member is configured to prevent deformation of a head of the second sheet caused by the feed roller and the separating pad nipping the second sheet.

This patent specification further describes a novel sheet feeding method. One example of a novel sheet feeding method includes loading sheets including first and second sheets, driving a feed roller with a feed motor, and picking up and feeding the first and second sheets with the feed roller. The method further includes separating the first sheet from the second sheet with the feed roller and a separating pad, and conveying the first sheet fed by the feed roller with a conveying roller pair provided downstream from the feed roller in a sheet conveyance direction. The method further includes preventing deformation of a head of the second sheet caused by the feed roller and the separating pad nipping the second sheet.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
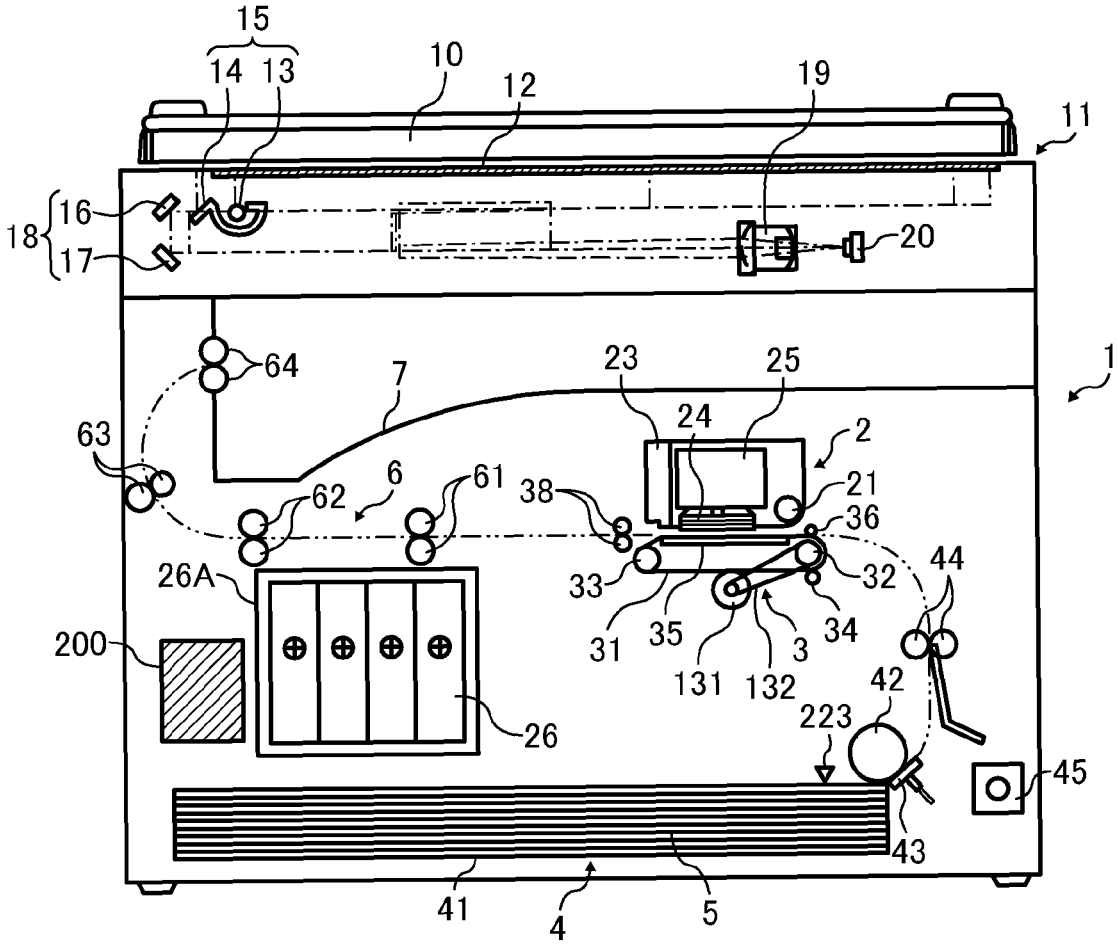
FIG. 1 is a schematic view of an image forming apparatus according to an exemplary embodiment.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 1 according to an exemplary embodiment is explained.

FIG. 1 is a schematic view of the image forming apparatus 1. As illustrated in FIG. 1, the image forming apparatus 1 includes an exposure glass cover 10, a reader 11, a paper tray unit 4, a sub-scanning direction conveyer 3, an image forming device 2, ink cartridges 26, a cartridge holder 26A, an output conveyer 6, an output tray 7, and a controller 200. The reader 11 includes an exposure glass 12, a first carriage 15, a second carriage 18, a lens 19, and an image scanning element 20. The first carriage 15 includes a light source 13 and a first mirror 14. The second carriage 18 includes a second mirror 16 and a third mirror 17. The paper tray unit 4 includes a paper tray 41, a feed roller 42, a friction pad 43, a sheet sensor 223, a conveying roller pair 44, and a feed motor 45. The sub-scanning direction conveyer 3 includes a conveying belt 31, a sub-scanning motor 131, a timing belt 132, a conveying roller 32, a tension roller 33, a charging roller 34, a guide 35, a pressing roller 36, and a conveying roller pair 38. The image forming device 2 includes a carriage guide 21, a carriage 23, recording heads 24, and sub tanks 25. The output conveyer 6 includes conveying output roller pairs 61, 62, and 63 and an output roller pair 64.

The image forming apparatus 1 can be included in any of a copying machine, a printer, a facsimile machine, and a multifunction printer including two or more of copying, printing, scanning, and facsimile functions. In this non-limiting exemplary embodiment, the image forming apparatus 1 functions as a color copying machine for forming a color image on a recording medium in a liquid discharging method by discharging liquid drops onto the recording medium. However, the image forming apparatus 1 may be an image forming apparatus for forming an image in other method, for example, an electrophotographic method.

The exposure glass cover 10 is provided on the exposure glass 12 of the reader 11 and presses an original placed on the exposure glass 12. The reader 11 (e.g., a scanner) is disposed in an upper portion of the image forming apparatus 1 and above the output tray 7. The reader 11 optically scans an image on the original to generate image data, performs image processing on the image data, and sends the processed image data to a print controller (not shown) of the image forming device 2.

In the reader 11, the light source 13 and the first mirror 14 are mounted on the first carriage 15. The second mirror 16 and the third mirror 17 are mounted on the second carriage 18. The first carriage 15 and the second carriage 18 move in a sub-scanning direction to scan an image on the original placed on the exposure glass 12. The second carriage 18 moves at a half speed of the first carriage 15. The light source 13 emits light onto the original. The first mirror 14 deflects light reflected by the original toward the second mirror 16. The second mirror 16 deflects the light toward the third mirror 17. The third mirror 17 deflects the light toward the lens 19. The image scanning element 20 is provided behind the lens 19. The light enters the lens 19 and forms a shrunk image on an image forming surface of the image scanning element 20. The image scanning element 20 reads the formed image as an analog image signal. The analog image signal is digitized and processed into a print image signal. The print image signal is sent to the image forming device 2. The image forming device 2 forms an image on a recording medium according to the print image signal.

In the image forming apparatus 1, the image forming device 2 may form an image according to image data (e.g., print data) sent by a device other than the reader 11, such as an information processing device (e.g., a personal computer), an image reading device (e.g., an image scanner), or a shooting device (e.g., a digital camera). In this case, the image forming apparatus 1 receives the image data sent by the device via a cable or a network, processes the image data, and prints an image according to the processed image data.

The paper tray unit 4, serving as a sheet feeder, is provided in a bottom of the image forming apparatus 1. In the paper tray unit 4, the paper tray 41 loads a recording medium (e.g., a plurality of sheets 5), and is attachable to and detachable from the image forming apparatus 1. According to this non-limiting exemplary embodiment, the paper tray 41 serves as a sheet tray. However, the sheet tray is not limited to a tray and may have other shape (e.g., a cassette, a plate, or the like). The feed roller 42 picks up and feeds an uppermost sheet 5 of the plurality of sheets 5 placed on the paper tray 41 one by one toward the conveying roller pair 44. The friction pad 43, serving as a separating pad, separates the uppermost sheet 5 from the other sheets 5 when the feed roller 42 feeds the uppermost sheet 5. The sheet sensor 223 serves as a detector for detecting a sheet 5 at a position upstream from the friction pad 43 in a sheet conveyance direction. The conveying roller pair 44 feeds the sheet 5 fed by the feed roller 42 toward the sub-scanning direction conveyer 3. The feed motor 45 includes an HB (hybrid) type stepping motor and serves as a driver for rotatably driving the feed roller 42 and the conveying roller pair 44 via a feeding clutch (not shown).

The sub-scanning direction conveyer 3, serving as a conveyer, intermittently conveys the sheet 5 fed by the conveying roller pair 44 in the sub-scanning direction toward the output conveyer 6 in a manner that the sheet 5 opposes the image forming device 2. In the sub-scanning direction conveyer 3, the conveying belt 31 is formed in an endless belt-like shape and is looped over the conveying roller 32 and the tension roller 33. The conveying belt 31 turns a direction in which the sheet 5 fed by the conveying roller pair 44 is conveyed by about 90 degrees so that the sheet 5 opposes the image forming device 2. The sub-scanning motor 131 drives the conveying roller 32 via the timing belt 132. The conveying roller 32 serves as a driving roller for rotatably driving the conveying belt 31. The tension roller 33 serves as a driven roller for being rotatably driven by the conveying roller 32 via the conveying belt 31, and applies tension to the conveying belt 31. A high voltage power source (not shown) applies a high, alternating voltage to the charging roller 34. The charging roller 34, serving as a charger, applies the alternating voltage to the conveying belt 31 to charge a surface of the conveying belt 31. The guide 35 opposes the image forming device 2 and guides the rotating conveying belt 31. The pressing roller 36 opposes the conveying roller 32 via the conveying belt 31 and presses the sheet 5 conveyed on the conveying belt 31 toward the conveying belt 31. The conveying roller pair 38 feeds the sheet 5 toward the output conveyer 6.

The image forming device 2 discharges a liquid drop (e.g., an ink drop) onto the sheet 5 according to the image data sent by the reader 11 to form an image on the sheet 5 at an opposing position at which the image forming device 2 opposes the sub-scanning direction conveyer 3, while the sheet 5 is intermittently conveyed by the sub-scanning direction conveyer 3. In the image forming device 2, the carriage guide 21 supports the carriage 23 in a manner that the carriage 23 is movable in a main scanning direction. The carriage 23 carries the recording heads 24. The recording heads 24 discharge ink drops onto the sheet 5 conveyed on the conveying belt 31. The sub tanks 25 contain ink to be supplied to the recording heads 24.

The ink cartridges 26 contain black, cyan, magenta, and yellow inks, respectively, and are attachable to and detachable from the cartridge holder 26A disposed in a front of the image forming apparatus 1. The black, cyan, magenta, and yellow inks contained in the ink cartridges 26 are supplied to the sub tanks 25, respectively. The black ink is supplied from one ink cartridge 26 to two sub tanks 25.

The output conveyer 6 conveys the sheet 5 bearing the image toward the output tray 7. In the output conveyer 6, the conveying output roller pairs 61 and 62 feed the sheet 5 bearing the image toward the conveying output roller pair 63. The conveying output roller pair 63 and the output roller pair 64 feed the sheet 5 bearing the image onto the output tray 7. The output tray 7 is disposed in the upper portion of the image forming apparatus 1 and receives the sheet 5 fed by the output roller pair 64.

The controller 200 controls operations of the image forming apparatus 1.

Figure 2:
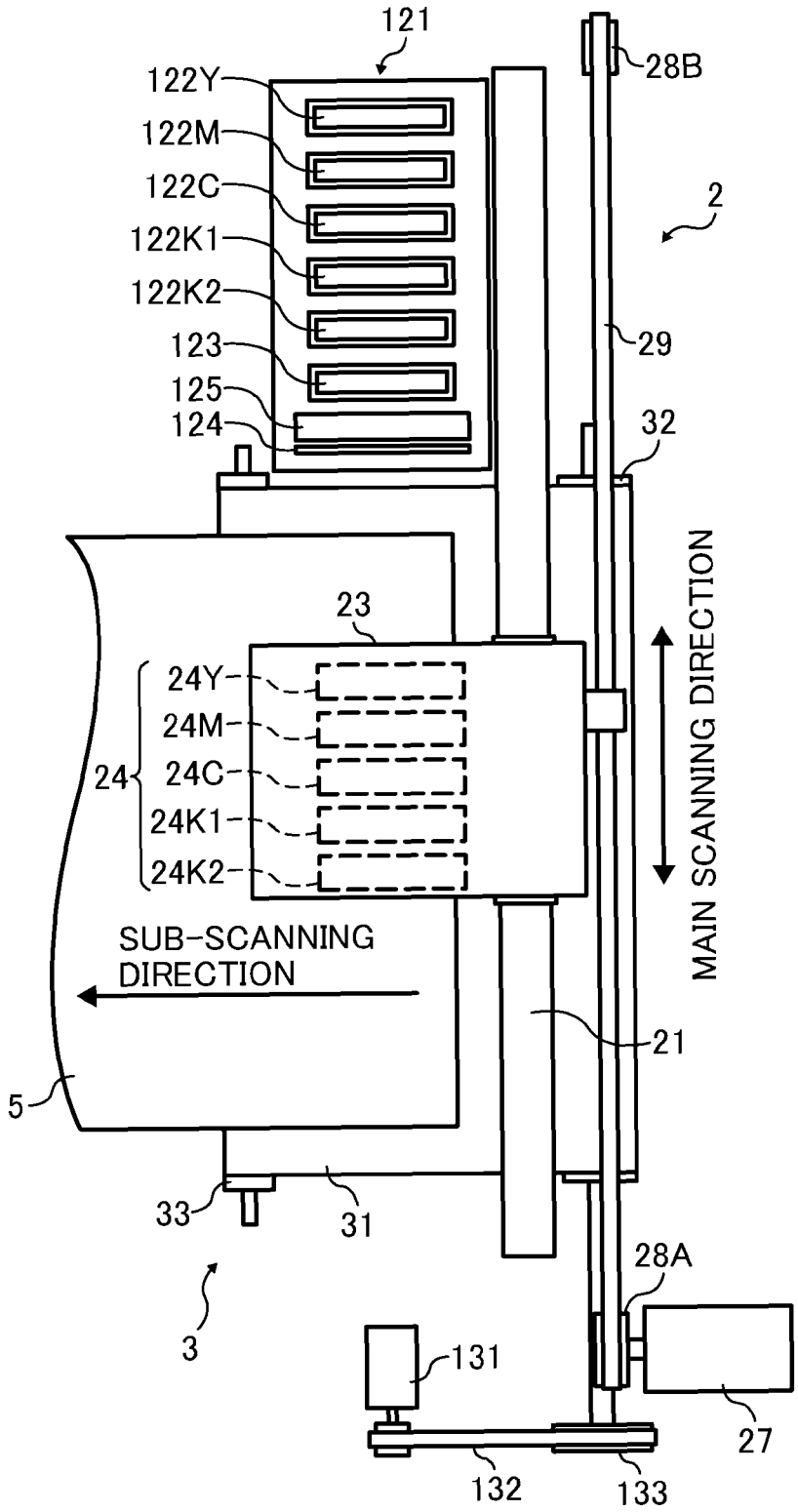
FIG. 2 is a plane view of an image forming device and a conveyer of the image forming apparatus shown in FIG. 1.

FIG. 2 is a plane view of the image forming device 2 and the sub-scanning direction conveyer 3. As illustrated in FIG. 2, the image forming device 2 further includes a timing belt 29, a driving pulley 28A, a driven pulley 28B, a main scanning motor 27, and a maintenance-recovery mechanism 121. The sub-scanning direction conveyer 3 further includes a timing roller 133. The recording heads 24 include liquid drop discharging heads 24K2, 24K1, 24C, 24M, and 24Y. The maintenance-recovery mechanism 121 includes moisture retaining caps 122K2, 122K1, 122C, 122M, and 122Y, a sucking cap 123, a wiper blade 124, and an idle discharge receiver 125.

In the image forming device 2, the carriage guide 21 and a stay (not shown) support the carriage 23 in a manner that the carriage 23 is movable in a main scanning direction. The timing belt 29 is looped over the driving pulley 28A and the driven pulley 28B. The main scanning motor 27 rotates the driving pulley 28A. The rotating driving pulley 28A rotates the timing belt 29. The rotating timing belt 29 rotates the driven pulley 28B. The carriage 23 is attached to the timing belt 29. Thus, the main scanning motor 27 moves the carriage 23 via the driving pulley 28A, the driven pulley 28B, and the timing belt 29 in the main scanning direction.

The recording heads 24 are mounted on the carriage 23 and discharge ink drops in a shuttle method. For example, while the sub-scanning direction conveyer 3 intermittently conveys a sheet 5 in a sheet conveyance direction (i.e., a sub-scanning direction), the recording heads 24 mounted on the carriage 23 and moving in the main scanning direction discharge ink drops onto the sheet 5 to form an image.

The recording heads 24 include five liquid drop discharging heads 24K2, 24K1, 24C, 24M, and 24Y. The liquid drop, discharging heads 24K2 and 24K1 discharge black ink. The liquid drop discharging heads 24C, 24M, and 24Y discharge cyan, magenta, and yellow inks, respectively. The black, cyan, magenta, and yellow inks are supplied from the sub tanks 25 (depicted in FIG. 1) mounted on the carriage 23, respectively.

Multiple types of the recording heads 24 including piezo, thermal, and electrostatic types may be used. The piezo type recording head uses a piezoelectric element as a pressure generator (e.g., an actuator) for applying pressure on ink in an ink flow route (e.g., a pressure generating chamber) to deform a vibration board forming walls of the ink flow route, so that a changed volume of the ink flow route discharges an ink drop. The thermal type recording head uses a heat generating resistance body to generate a bubble by boiling ink in an ink flow route, so that pressure of the bubble discharges an ink drop. The electrostatic type recording head uses a vibration board forming walls of an ink flow route and an electrode, which oppose each other, so that the vibration board deformed by an electrostatic force generated between the vibration board and the electrode changes a volume of the ink flow route and discharges an ink drop.

The maintenance-recovery mechanism 121 is disposed in a non-printing area near one end of the carriage guide 21 in the main scanning direction. The maintenance-recovery mechanism 121 includes a head cleaner, and maintains and recovers conditions of nozzles of the recording heads 24. The five moisture retaining caps 122K2, 122K1, 122C, 122M, and 122Y cap the nozzles of the five liquid drop discharging heads 24K2, 24K1, 24C, 24M, and 24Y, respectively. The sucking cap 123 sucks ink from the recording heads 24. The wiper blade 124 wipes the nozzles of the recording heads 24. The idle discharge receiver 125 receives an ink drop which is discharged during idle discharge and is not used for printing.

In the sub-scanning direction conveyer 3, the sub-scanning motor 131 rotates the timing belt 132. The rotating timing belt 132 rotates the timing roller 133. The rotating timing roller 133 rotates the conveying roller 32. The rotating conveying roller 32 rotates the conveying belt 31 in the sheet conveyance direction (i.e., in the sub-scanning direction).

Figure 3:
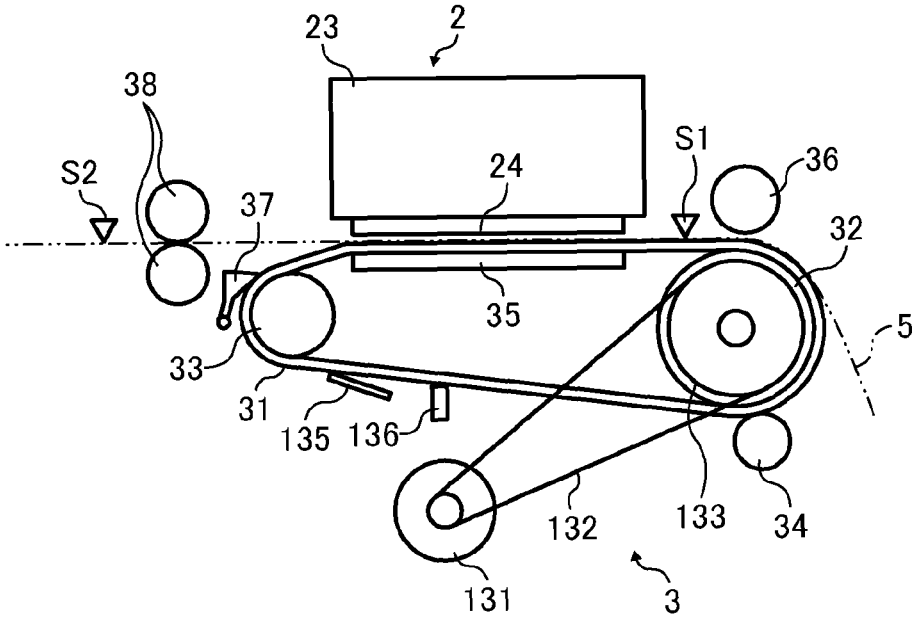
FIG. 3 is a sectional view of the image forming device and the conveyer shown in FIG. 2.

FIG. 3 is a sectional view of the image forming device 2 and the sub-scanning direction conveyer 3. As illustrated in FIG. 3, the sub-scanning direction conveyer 3 further includes a separating nail 37, a cleaner 135, a discharging brush 136, a print start sensor S1, and a print finish sensor S2.

The separating nail 37 separates a sheet 5 bearing an image formed by the image forming device 2 from the conveying belt 31. The cleaner 135 and the discharging brush 136 are provided at positions between the tension roller 33 and the charging roller 34 in a sheet conveyance direction, respectively. The cleaner 135 removes an adherent (e.g., paper dust) from the surface of the conveying belt 31. According to this non-limiting exemplary embodiment, the cleaner 135 includes Mylar®. The discharging brush 136 discharges the surface of the conveying belt 31. The print start sensor S1 is provided upstream from the recording heads 24 in the sheet conveyance direction, and detects a sheet 5 passing a nip formed between the conveying roller 32 and the pressing roller 36. The print finish sensor S2 is provided downstream from the conveying roller pair 38 in the sheet conveyance direction, and detects the sheet 5 passing the conveying roller pair 38.

Figure 4:
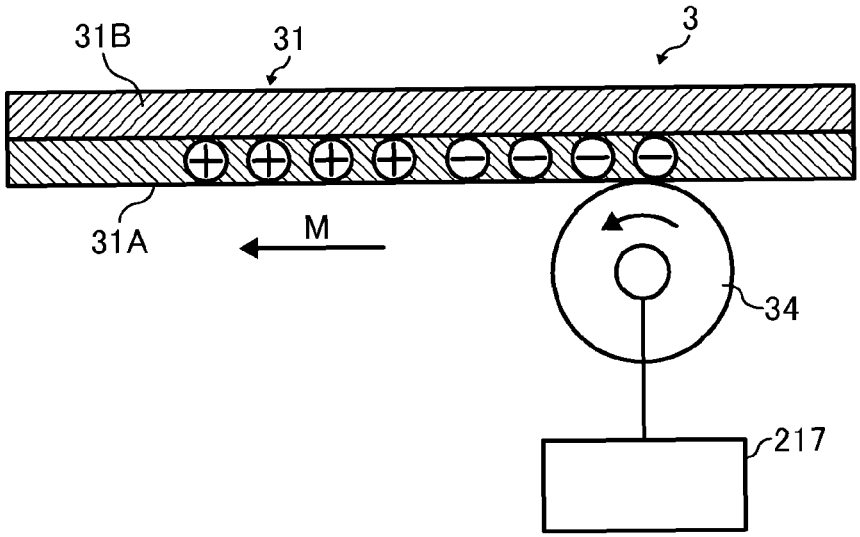
FIG. 4 is an enlarged sectional view of the conveyer shown in FIG. 3.

FIG. 4 is an enlarged sectional view of the sub-scanning direction conveyer 3. As illustrated in FIG. 4, the sub-scanning direction conveyer 3 further includes an alternating current bias supplier 217. The conveying belt 31 includes a front layer 31A and a back layer 31B.

The alternating current bias supplier 217 applies an alternating voltage (e.g., a square-wave, high voltage) to the charging roller 34. The conveying belt 31 moves in a moving direction M and includes two layers. For example, the front layer 31A includes a resin to which resistance control is not performed. Specifically, the front layer 31A includes an ETFE (ethylene-tetrafluoroethylene) material, and attracts a sheet 5. The back layer 31B (e.g., a medium resistance layer and a grounded layer) includes a material common to the front layer 31A to which resistance control is performed with carbon.

Figure 5:
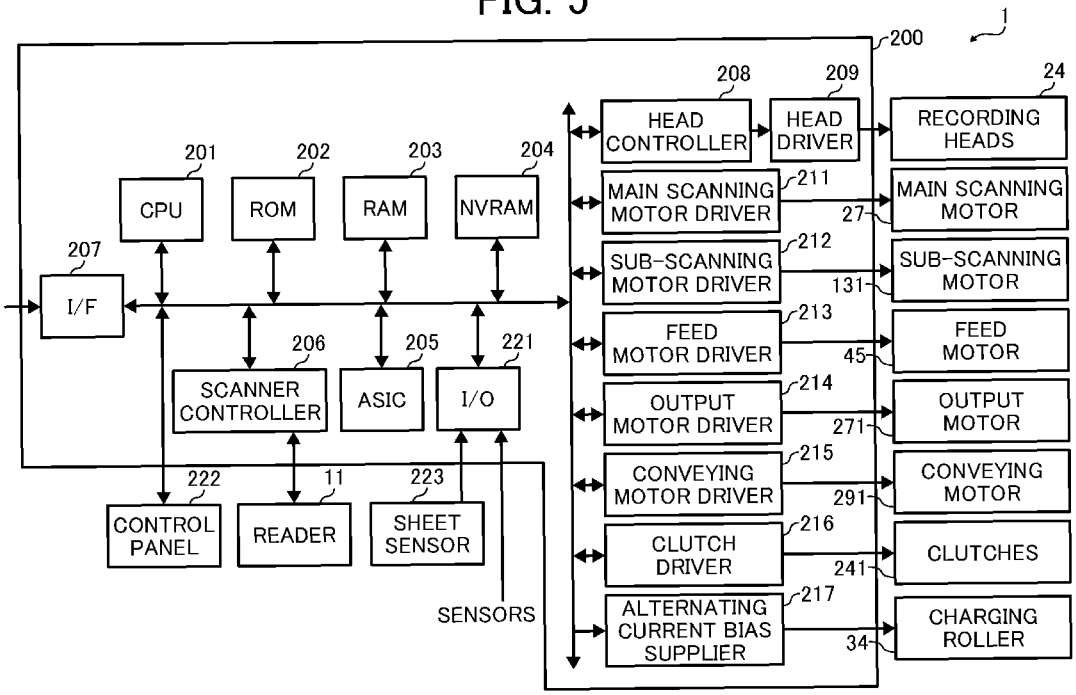
FIG. 5 is a block diagram of a controller of the image forming apparatus shown in FIG. 1.

FIG. 5 is a block diagram of the controller 200. As illustrated in FIG. 5, the image forming apparatus 1 further includes an output motor 271, a conveying motor 291, clutches 241, and a control panel 222. The controller 200 includes a CPU (central processing unit) 201, a ROM (read-only memory) 202, a RAM (random-access memory) 203, a NVRAM (nonvolatile random-access memory) 204, an ASIC (application-specific integrated circuit) 205, a scanner controller 206, an I/O (input output) 221, an I/F (interface) 207, a head driver 209, a head controller 208, a main scanning motor driver 211, a sub-scanning motor driver 212, a feed motor driver 213, an output motor driver 214, a conveying motor driver 215, and a clutch driver 216.

The CPU 201, serving as a controller and a deformation prevention member for preventing deformation of a sheet 5, controls operations of the image forming apparatus 1. The ROM 202 stores a program executed by the CPU 201 and data. The RAM 203 temporarily stores image data. The NVRAM 204 maintains data even when the image forming apparatus 1 is powered off. The ASIC 205 processes various signals used for image processing and input and output signals used for controlling the image forming apparatus 1. The scanner controller 206 controls the reader 11. The I/O 221 controls input and output signals sent by sensors.

The interface 207 sends and receives data and signals to and from a host. The head driver 209 drives the recording heads 24. The head controller 208 controls the head driver 209. The main scanning motor driver 211 drives the main scanning motor 27. The sub-scanning motor driver 212 drives the sub-scanning motor 131. The feed motor driver 213 drives the feed motor 45. The output motor 271 drives the conveying output roller pairs 61, 62, and 63 and the output roller pair 64 (depicted in FIG. 1). The output motor driver 214 drives the output motor 271. The conveying motor 291 drives the pressing roller 36 and the conveying roller pair 38 (depicted in FIG. 1). The conveying motor driver 215 drives the conveying motor 291. The clutches 241 include a feeding clutch. The clutch driver 216 drives a motor (not shown) used for supplying ink and the clutches 241. The I/O 221 receives detection signals sent by various sensors including the print start sensor S1, the print finish sensor S2 (depicted in FIG. 3), a home position sensor (not shown) for the maintenance-recovery mechanism 121 (depicted in FIG. 2), and a sensor (not shown) for detecting opening of a cover of the image forming apparatus 1. The control panel 222 is connected to the controller 200, and displays information for operating the image forming apparatus 1. A user may operate the image forming apparatus 1 by using the control panel 222.

In the controller 200, the I/F 207 receives print data sent from a host such as an information processing device (e.g., a personal computer), an image reading device (e.g., an image scanner), and a shooting device (e.g., a digital camera) via a cable or a network. The CPU 201 reads and analyses the received print data from a reception buffer included in the I/F 207. The ASIC 205 performs image processing and/or data arrangement, and sends processed image data to the head controller 208. When the head controller 208 receives image data (e.g., dot pattern data) corresponding to one line of an image to be formed by the recording heads 24, the head controller 208 sends the dot pattern data corresponding to one line, as serial data, to the head driver 209 in synchronism with a clock signal. The head controller 208 also sends a latch signal to the head driver 209 at a predetermined time. The head controller 208 includes a ROM for storing pattern data having a driving waveform (e.g., a driving signal), a waveform generating circuit including a D/A (digital-analog) converter for performing digital-analog conversion on the pattern data having the waveform read from the ROM, and a driving waveform generating circuit including an amplifier. The head controller 208 may include the ROM 202.

The head driver 209 includes a shift register, a latch circuit, a level conversion circuit (e.g., a level shifter), and an analog switch array (e.g., a switcher). The shift register receives a clock signal and serial data (i.e., image data) sent from the head controller 208. The latch circuit latches a registration value generated by the shift register in accordance with a latch signal sent from the head controller 208. The level conversion circuit changes a level of an output value of the latch circuit. The level conversion circuit turns on and off the analog switch array. The controller 200 controls turning on and off of the analog switch array to selectively apply a desired driving waveform to an actuator of the recording heads 24, so as to drive the recording heads 24. Further, the controller 200 controls the alternating current bias supplier 217, so that the charging roller 34 applies an alternating voltage having a voltage value to the conveying belt 31 (depicted in FIG. 4). Thus, the conveying belt 31 may attract and convey a sheet 5 with a desired attracting force.

A slit disk is provided at an end of the conveying roller 32 (depicted in FIG. 3) for driving the conveying belt 31. An encoder including a photo sensor detects the slit disk to determine a rotation amount of the conveying roller 32. The controller 200 controls the sub-scanning motor driver 212 to drive the sub-scanning motor 131 in accordance with the detected rotation amount of the conveying roller 32. Further, the alternating current bias supplier 217 applies an alternating voltage (e.g., a square-wave, high voltage having positive and negative polarities) to the charging roller 34. As illustrated in FIG. 4, the charging roller 34 contacts the front layer 31A (e.g., an insulating layer) of the conveying belt 31. Thus, positive and negative charges are applied to the front layer 31A in a manner that positive and negative stripes are alternately formed on the conveying belt 31 in a sheet conveyance direction (i.e., the moving direction M). The conveying belt 31 is charged to have a predetermined charging width. Thus, an uneven electric field is generated. A combination of positive and negative charging widths is defined as a "charging cycle length".

As illustrated in FIG. 1, a sheet 5 is fed from the paper tray unit 4 to the nip formed between the conveying roller 32 and the pressing roller 36. When the sheet 5 is sent onto the conveying belt 31 on which positive and negative charges in the front layer 31A (depicted in FIG. 4) generate an uneven electric field, the sheet 5 is quickly polarized in accordance with a direction of the electric field. The conveying belt 31 attracts the sheet 5 with an electrostatic force, and conveys the sheet 5 when the conveying belt 31 moves. While the conveying belt 31 intermittently conveys the sheet 5, the recording heads 24 discharge a liquid drop onto the sheet 5 to record or print an image on the sheet 5. The separating nail 37 (depicted in FIG. 3) separates a head of the sheet 5 bearing the image from the conveying belt 31. The conveying-roller pair 38 feeds the sheet 5 to the output conveyer 6.

Figure 6:
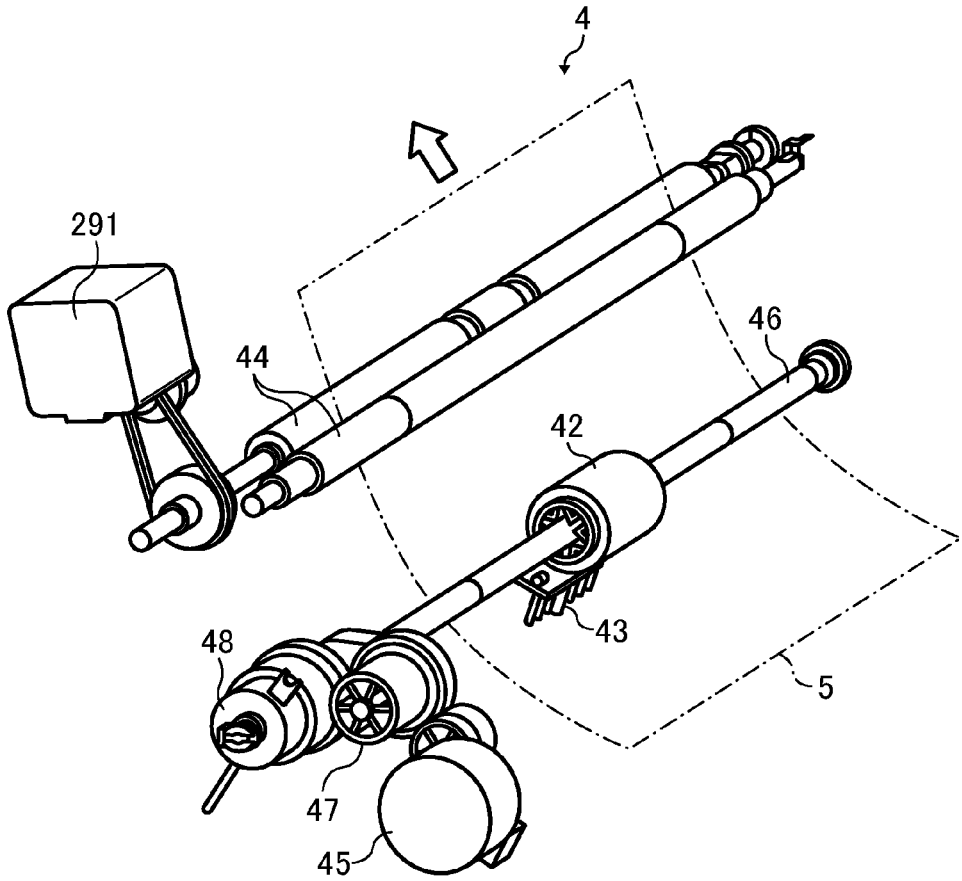
FIG. 6 is a perspective view of a sheet feeder of the image forming apparatus shown in FIG. 1.

FIG. 6 is a perspective view of the paper tray unit 4. As illustrated in FIG. 6, the paper tray unit 4 further includes a feed roller shaft 46, a feed roller clutch 48, and a connecting gear 47.

The feed roller 42 is attached to the feed roller shaft 46. The feed roller clutch 48 is connected to an end of the feed roller shaft 46, and includes an electromagnetic clutch mechanism. The feed roller clutch 48 controls transmission of a driving force generated by the feed motor 45 including a stepping motor to the feed roller shaft 46. For example, the feed roller clutch 48 transmits the driving force generated by the feed motor 45 to the feed roller shaft 46 via the connecting gear 47 so as to rotate the feed roller 42. The feed roller clutch 48 does not transmit the driving force generated by the feed motor 45 to the feed roller shaft 46 so as to stop the rotating feed roller 42. The feed roller clutch 48 may control transmission of the driving force generated by the feed motor 45 to use the driving force generated by the feed motor 45 as a driving source for driving an element other than the feed roller 42. According to this non-limiting exemplary embodiment, when the feed roller clutch 48 is turned on and thereby the feed roller 42 is driven, the feed roller 42 feeds or conveys a sheet 5. When the feed roller clutch 48 is turned off, the feed roller 42 is not driven. However, when the conveying roller pair 44 conveys the sheet 5, the conveyed sheet 5 rotates the feed roller 42.

The conveying roller pair 44 provided downstream from the feed roller 42 in a sheet conveyance direction feeds the sheet 5 separated from a next sheet 5 by the feed roller 42 and the friction pad 43. The conveying motor 291 provided independently of the feed motor 45 drives the conveying roller pair 44. When the conveying roller pair 44 nips the sheet 5, the feed motor 45 or the feed roller clutch 48 is turned off. Thus, the feed roller 42 loses a conveying force for conveying the sheet 5, and is rotated by the sheet 5 conveyed by the conveying roller pair 44. As a result, the rotating feed roller 42 feeds the next sheet 5 to the friction pad 43. When the next sheet 5 touches the friction pad 43 for a long time period, a head of the next sheet 5 may be substantially deformed.

Figure 7:
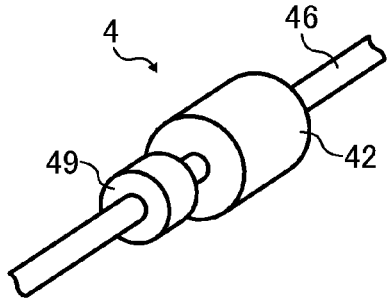
FIG. 7 is an enlarged perspective view of the sheet feeder shown in FIG. 6.

FIG. 7 is an enlarged perspective view of the paper tray unit 4. As illustrated in FIG. 7, the paper tray unit 4 further includes a torque limiter 49.

The torque limiter 49 applies a load to the feed roller 42 to prevent or reduce rotation of the feed roller 42 caused by a sheet 5 fed by the conveying roller pair 44 (depicted in FIG. 6). The torque limiter 49 includes a transmission mechanism for controlling transmission of a driving force between an inner ring and an outer ring of the torque limiter 49. The inner ring is attached to an outer circumferential surface of the feed roller shaft 46. An end of the outer ring is fixed to the feed roller 42. Thus, when a predetermined load (e.g., a setting of the torque limiter 49) is applied between the inner ring rotating together with the feed roller shaft 46 and the outer ring rotating together with the feed roller 42, the feed roller 42 is rotated. The torque limiter 49 may include various known format and mechanism. Specifically, the torque limiter 49 may include any format and mechanism which may control rotation of the feed roller shaft 46 and turning on and off of transmission of a driving force for driving the feed roller 42 in accordance with a setting of the torque limiter 49.

As a method for applying a load to the feed roller 42, the feed motor 45 (depicted in FIG. 6) including a stepping motor may be turned off or may not be energized and the feed roller clutch 48 (depicted in FIG. 6) may be turned on. Thus, a detent torque of the stepping motor and a load of gears may be applied to the feed roller 42 and the feed roller 42 rotates with a predetermined load (e.g., about 150 gf·cm) applied. This method may provide effects similar to the effects provided by the torque limiter 49.

Figure 8:
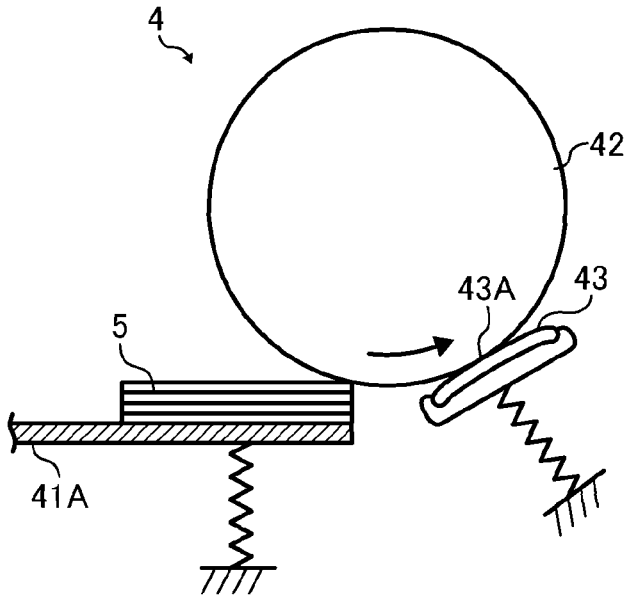
FIG. 8 is a sectional view of the sheet feeder shown in FIG. 6 for picking up a sheet.

Referring to FIG. 8, the following describes operations of the paper tray unit 4 when the torque limiter 49 (depicted in FIG. 7), the feed roller clutch 48 (depicted in FIG. 6), and the above-described stepping motor apply a load to the feed roller 42. FIG. 8 illustrates the feed roller 42 picking up and feeding a sheet 5. As illustrated in FIG. 8, the paper tray unit 4 further includes a bottom plate 41A.

The bottom plate 41A is provided in the paper tray 41 (depicted in FIG. 1). The bottom plate 41A loads sheets 5 and presses the sheets 5 toward the feed roller 42. The rotating feed roller 42 picks up the sheets 5 from the paper tray 41. When a head of a first sheet 5 enters a nip 43A formed between the feed roller 42 and the friction pad 43, the feed roller 42 and the friction pad 43 separate the first sheet 5 from a next sheet 5 (i.e., a second sheet 5) and feed the first sheet 5. When the second sheet 5 touches the friction pad 43, the second sheet 5 stops at a position at which the second sheet 5 touches the friction pad 43. When the conveying roller pair 44 (depicted in FIG. 6) nips and feeds the first sheet 5, the first sheet 5 fed by the conveying roller pair 44 rotates the feed roller 42. When the second sheet 5 touches the feed roller 42 in a state that the first sheet 5 is not layered on the second sheet 5, the feed roller 42 conveys the second sheet 5 onto the friction pad 43.

Figure 9:
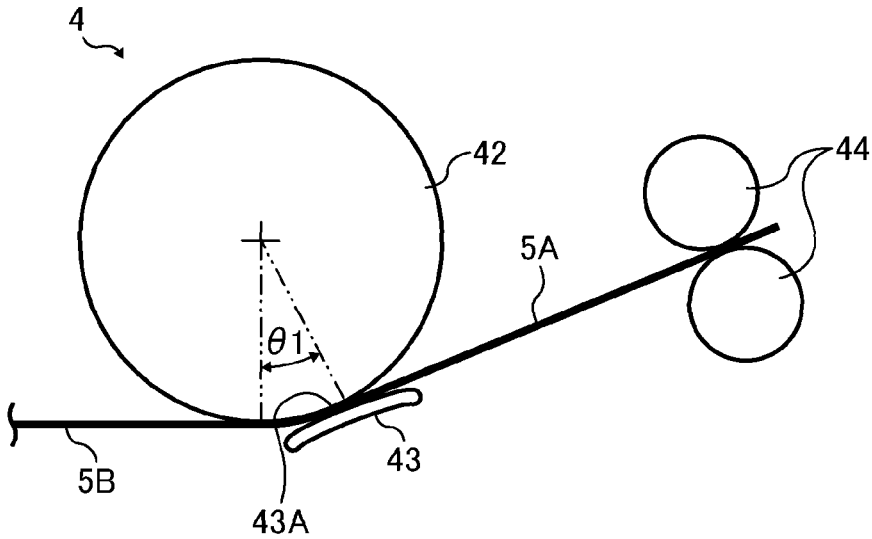
FIG. 9 is a sectional view of a conveying roller pair of the sheet feeder shown in FIG. 6 provided at a position.
Figure 10:
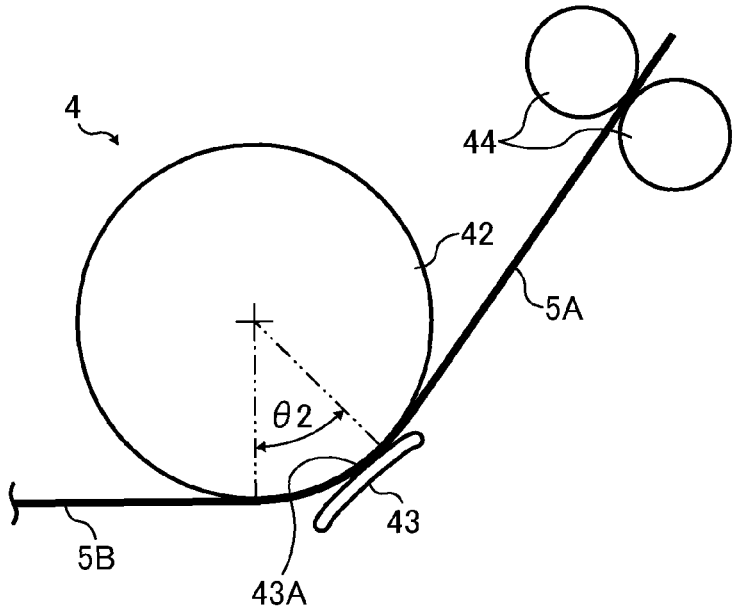
FIG. 10 is a sectional view of the conveying roller pair shown in FIG. 9 provided at another position.

An amount of the second sheet 5 fed by the conveying roller pair 44 varies depending on a position of the conveying roller pair 44. FIGS. 9 and 10 illustrate a relationship among a first sheet 5A, a second sheet 5B, and the feed roller 42 varying depending on the position of the conveying roller pair 44. In FIG. 9, the feed roller 42 and the second sheet 5B contacting the feed roller 42 form an angle θ1 when the conveying roller pair 44 is positioned with respect to the bottom plate 41A (depicted in FIG. 8) at a position relatively near a horizontal direction. In FIG. 10, the feed roller 42 and the second sheet 5B contacting the feed roller 42 form an angle θ2 when the conveying roller pair 44 is positioned with respect to the bottom plate 41A at a position relatively near a vertical direction. The angles θ1 and θ2 show that a head of the second sheet 5B is positioned at different positions. For example, when the conveying roller pair 44 is positioned at the position near the vertical direction as illustrated in FIG. 10, the head of the second sheet 5B enters the nip 43A formed between the feed roller 42 and the friction pad 43 to a deeper position. When the second sheet 5B stops at the deeper position for a long time period, the head of the second sheet 5B may be substantially deformed.

To prevent or reduce deformation of the second sheet 5B, an increased load is applied to the feed roller 42 to cause the first sheet 5A and the second sheet 5B to easily slip on the feed roller 42. When the feed roller 42 contacts a tail of the first sheet 5A, the first sheet 5A fed by the conveying roller pair 44 does not rotate the feed roller 42. Thus, the feed roller 42 may not convey the second sheet 5B to the deeper position on the friction pad 43. The second sheet 5B is stopped at the position illustrated in FIG. 9. As a result, deformation of the head of the second sheet 5B may be prevented or reduced.

Deformation of the head of the second sheet 5B may also be prevented or reduced by stopping the feed motor 45 (depicted in FIG. 6). For example, a stepping motor serving as the feed motor 45 is held or locked to stop rotating the feed roller 42. Thus, the second sheet 5B is not conveyed to the deeper position on the friction pad 43. When the feed motor 45 is held at a time when the tail of the first sheet 5A reaches a position about 15 mm upstream from a downstream end of the friction pad 43 in the sheet conveyance direction, slippage of the feed roller 42 may be reduced, resulting in improved durability of the feed roller 42.

Figure 11:
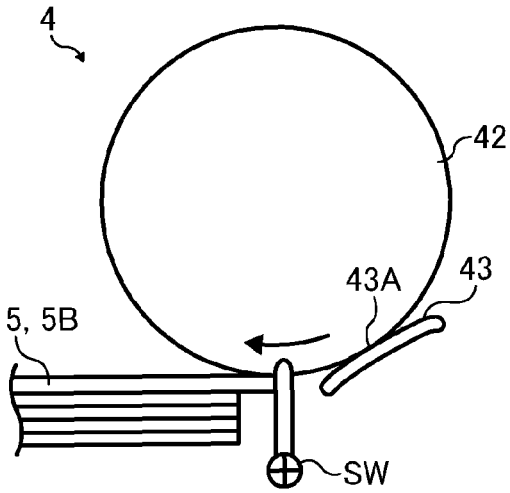
FIG. 11 is a sectional view of the sheet feeder shown in FIG. 6 for illustrating a sheet-deformation prevention method.

Referring to FIG. 11, the following describes an example method for preventing deformation of the head of the second sheet 5B. As illustrated in FIG. 11, the paper tray unit 4 further includes a switch SW. In this example method, when the feed roller 42 is stopped, the second sheet 5B does not reach the nip 43A formed between the feed roller 42 and the friction pad 43. The feed roller 42 rotates backward to move the head of the second sheet 5B out of the nip 43A formed between the feed roller 42 and the friction pad 43. For example, the switch SW or a sensor detects the second sheet 5B to stop the second sheet 5B at a predetermined stop position away from the nip 43A formed between the feeding roller 42 and the friction pad 43. Specifically, the switch SW serves as a detector for detecting the second sheet 5B at the stop position. The second sheet 5B is not held at the nip 43A formed between the feed roller 42 and the friction pad 43, preventing deformation of the second sheet 5B.

Figure 12:
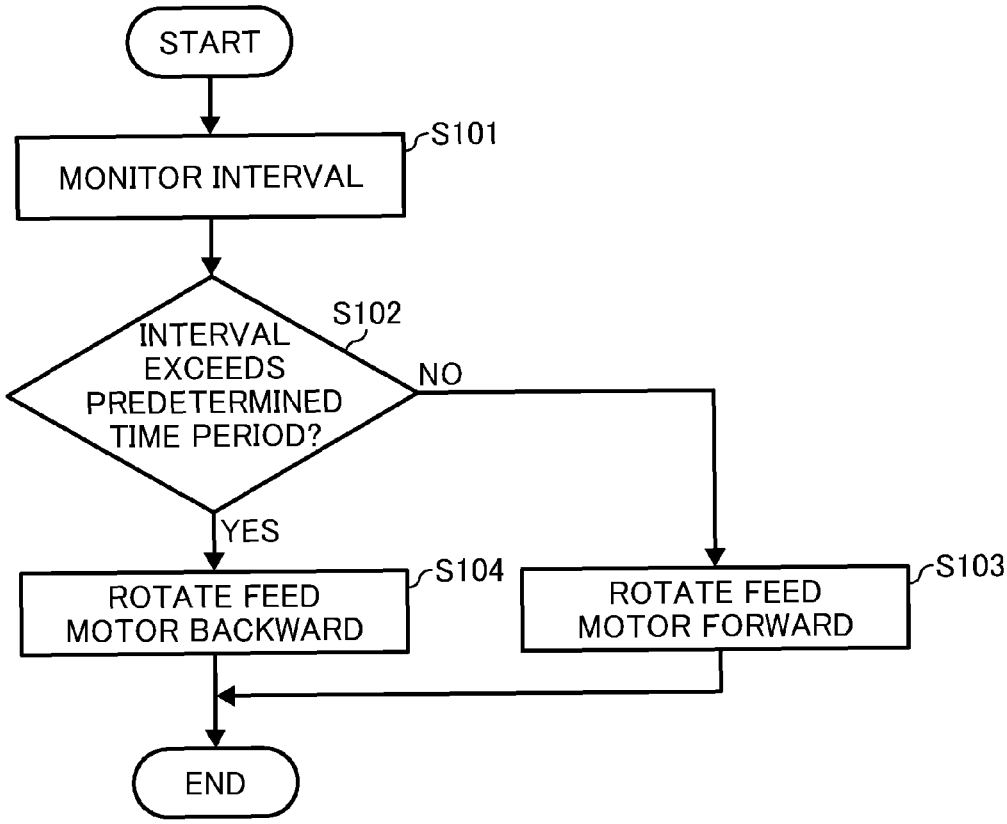
FIG. 12 is a flowchart illustrating processes of the sheet-deformation prevention method shown in FIG. 11.

FIG. 12 is a flowchart illustrating processes performed by the CPU 201 (depicted in FIG. 5) to rotate the feed roller 42 (depicted in FIG. 11) backward so as to prevent deformation of a second sheet 5B. In step S101, the CPU 201 turns on a timer (not shown) to monitor an interval between conveyance of a first sheet 5A and a second sheet 5B. In step S102, the CPU 201 determines whether the interval exceeds a predetermined time period or not. If the interval does not exceed the predetermined time period in step S102 (i.e., if NO is selected in step S102), the CPU 201 rotates the feed motor 45 (depicted in FIG. 6) forward in step S103. If the interval exceeds the predetermined time period in step S102 (i.e., if YES is selected in step S102), the CPU 201 rotates the feed motor 45 backward until the switch SW (depicted in FIG. 11) detects a head of the second sheet 5B in step S104. Thus, the head of the second sheet 5B moves out of the nip 43A formed between the feed roller 42 and the friction pad 43 (depicted in FIG. 11).

Figure 13:
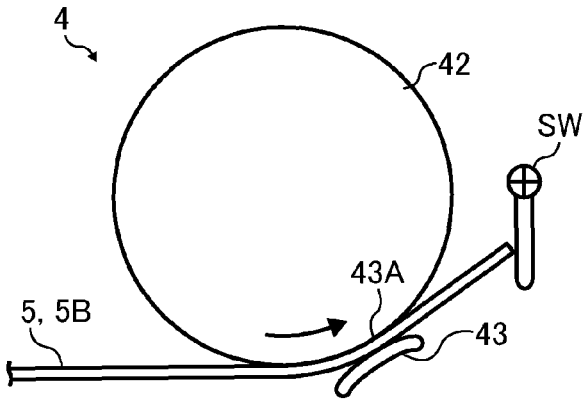
FIG. 13 is a sectional view of the sheet feeder shown in FIG. 6 for illustrating another sheet-deformation prevention method.

In FIG. 11, the head of the second sheet 5B is held at a stop position upstream from the nip 43A formed between the feed roller 42 and the friction pad 43 in the sheet conveyance direction. However, to prevent deformation of the head of the second sheet 5B, the head of the second sheet 5B may be held at any stop position other than the nip 43A formed between the feed roller 42 and the friction pad 43. Therefore, the head of the second sheet 5B may be stopped at a stop position downstream from the nip 43A formed between the feed roller 42 and the friction pad 43 in the sheet conveyance direction, as illustrated in FIG. 13. In this case, the feed roller 42 feeds the second sheet 5B for a predetermined time period after the feed roller 42 and the friction pad 43 separate the first sheet 5A from the second sheet 5B. For example, the head of the second sheet 5B is stopped at a stop position about 10 mm downstream from the friction pad 43 or the nip 43A in the sheet conveyance direction. The switch SW or a sensor (not shown) for detecting the head of the second sheet 5B may be provided to regulate the stop position at which the head of the second sheet 5B is stopped.

Figure 14:
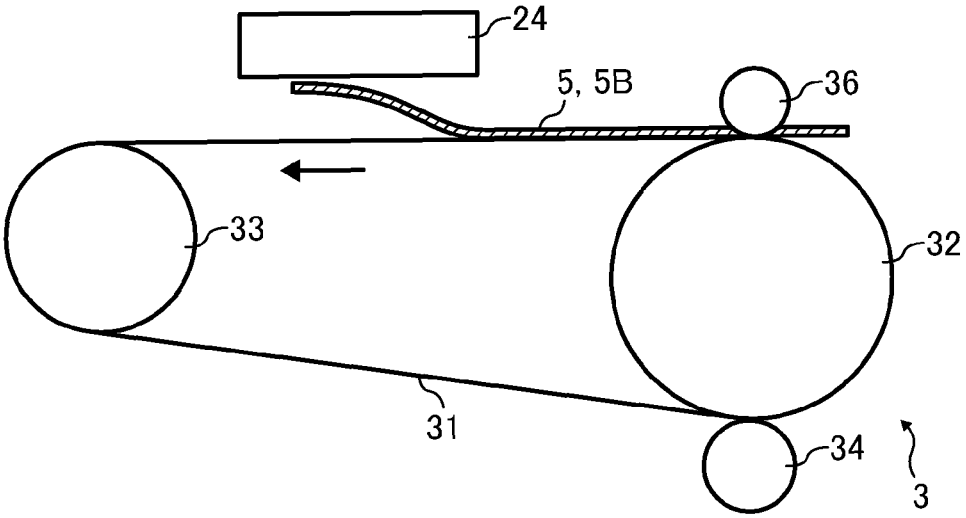
FIG. 14 is a sectional view of the conveyer shown in FIG. 3 for conveying a deformed sheet.

As illustrated in FIG. 10, when the second sheet 5B is stopped for a long time period in a state that the feed roller 42 and the friction pad 43 nip the head of the second sheet 5B, the head of the second sheet 5B may be deformed. As illustrated in FIG. 14, when the head of the second sheet 5B is deformed, an electrostatic belt serving as the conveying belt 31 may not attract the head of the second sheet 5B and the head of the second sheet 5B may be levitated above the conveying belt 31. Accordingly, the head of the second sheet 5B may contact and slide on the recording heads 24, resulting in formation of a faulty image. For example, the second sheet 5B contacts an opening of the recording heads 24 through which ink is discharged. Ink stains are layered on the second sheet 5B and form a faulty image.

Figure 15:
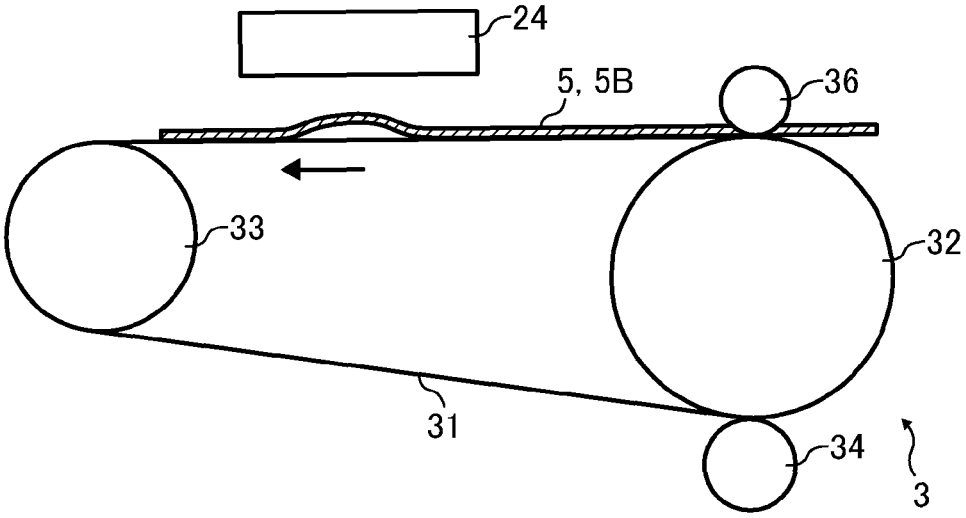
FIG. 15 is a sectional view of the conveyer shown in FIG. 3 for conveying a sheet fed by the sheet feeder shown in FIG. 13.

When the second sheet 5B is stopped in a state that the head of the second sheet 5B is at a stop position downstream from the nip 43A formed between the feed roller 42 and the friction pad 43 in the sheet conveyance direction as illustrated in FIG. 13, the head of the second sheet 5B is not deformed as illustrated in FIG. 15. Thus, the conveying belt 31 contacts and attracts the head of the second sheet 5B. As a result, the second sheet 5B may be levitated in a smaller amount than a second sheet 5B of which head is deformed. At least, the second sheet 5B may not contact the recording heads 24, preventing or reducing formation of a faulty image.

To reduce deformation (illustrated in FIG. 15) of the second sheet 5B caused when the head of the second sheet 5B is stopped at the stop position downstream from the nip 43A formed between the feed roller 42 and the friction pad 43 in the sheet conveyance direction as illustrated in FIG. 13, the CPU 201 (depicted in FIG. 5) may increase an attracting force of the conveying belt 31 for attracting the second sheet 5B, and thereby may prevent or reduce formation of a faulty image.

Figure 16:
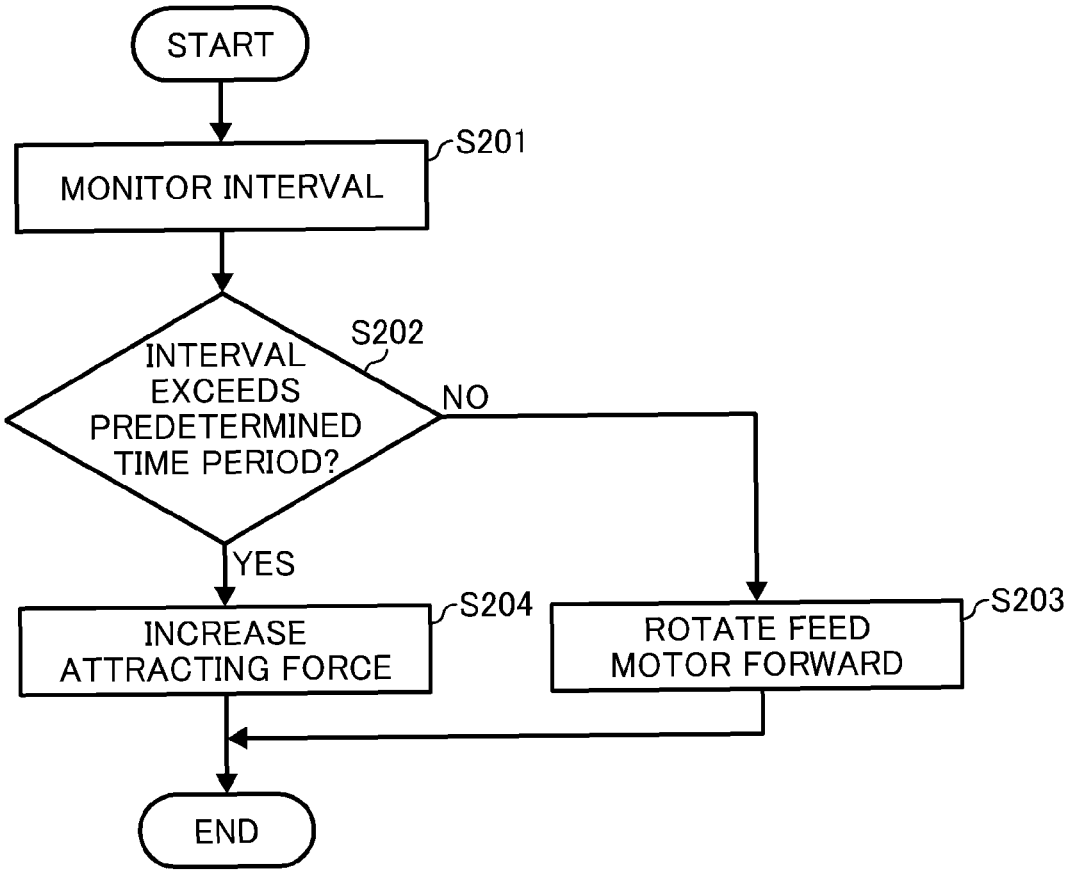
FIG. 16 is a flowchart illustrating processes of yet another sheet-deformation prevention method.

FIG. 16 is a flowchart illustrating processes performed by the CPU 201 (depicted in FIG. 5) to increase the attracting force of the conveying belt 31 (depicted in FIG. 15) so as to prevent deformation of a second sheet 5B. In step S201, the CPU 201 turns on a timer (not shown) to monitor an interval between conveyance of a first sheet 5A and a second sheet 5B. In step S202, the CPU 201 determines whether the interval exceeds a predetermined time period or not. If the interval does not exceed the predetermined time period in step S202 (i.e., if NO is selected in step S202), the CPU 201 rotates the feed motor 45 (depicted in FIG. 6) forward in step S203. If the interval exceeds the predetermined time period in step S202 (i.e., if YES is selected in step S202), the CPU 201 increases an attracting force of the conveying belt 31 for electrostatically attracting the second sheet 5B, so that the conveying belt 31 conveys the second sheet 5B toward the recording heads 24 (depicted in FIG. 15) by electrostatically attracting the second sheet 5B with an increased attracting force in step S204. To increase the attracting force of the conveying belt 31, the alternating current bias supplier 217 (depicted in. FIG. 4) applies an increased voltage to the charging roller 34 (depicted in FIG. 4) and supplies an increased amount of bias to the charging roller 34. Alternatively, the attracting force of the conveying belt 31 may be increased by decreasing a charging pitch applied to the charging roller 34 instead of or in addition to increasing the voltage applied by the alternating current bias supplier 217 to the charging roller 34.

As illustrated in FIG. 10, the second sheet 5B may be deformed when the feed roller 42 and the friction pad 43 nip the second sheet 5B for a long time period. Therefore, when sheets 5 are continuously fed, the CPU 201 (depicted in FIG. 5) may perform control for preventing the first sheet 5A fed by the conveying roller pair 44 from rotating the feed roller 42, when the second sheet 5B is a last sheet fed from the paper tray 41 (depicted in FIG. 1). Therefore, when no sheets 5 are left in the paper tray 41, the CPU 201 may not perform control for preventing a sheet 5 fed by the conveying roller pair 44 from rotating the feed roller 42. Specifically, the CPU 201 allows the sheet 5 fed by the conveying roller pair 44 to rotate the conveying roller 42. For example, a sensor (not shown) detects whether a second sheet 5B is left in the paper tray 41 or not. When no second sheet 5B is left in the paper tray 41, the CPU 201 does not lock the feed motor 45 (depicted in FIG. 6) for driving the feed roller 42, allowing a first sheet 5A fed by the conveying roller pair 44 to rotate the conveying roller 42.

As illustrated in FIG. 7, an increased load is applied to the feed roller 42 to prevent the feed roller 42 rotated by a first sheet 5A fed by the conveying roller pair 44 (depicted in FIG. 6) from feeding a second sheet 5B to the nip 43A (depicted in FIG. 8) formed between the feed roller 42 and the friction pad 43 (depicted in FIG. 8). Even when the second sheet 5B is left in the paper tray 41 (depicted in FIG. 1) for a long time period in a state that the conveying roller 42 and the friction pad 43 nip the second sheet 5B, a head of the second sheet 5B may not be substantially deformed.

As illustrated in FIGS. 11 and 13, a first sheet 5A fed by the conveying roller pair 44 (depicted in FIG. 6) does not rotate the feed roller 42. Thus, the feed roller 42 does not feed a second sheet 5B to the nip 43A formed between the feed roller 42 and the friction pad 43. Even when the second sheet 5B is left in the paper tray 41 (depicted in FIG. 1) for a long time period in a state that the conveying roller 42 and the friction pad 43 nip the second sheet 5B, a head of the second sheet 5B may not be substantially deformed.

When sheets 5 are continuously fed, the CPU 201 (depicted in FIG. 5) stops the conveying roller 42 when the second sheet 5B is a last sheet fed from the paper tray 41. A first sheet 5A slipping on the feed roller 42 moves out of the nip 43A formed between the feed roller 42 and the friction pad 43, reducing wear of the feed roller 42.

When no second sheet 5B is left in the paper tray 41, the CPU 201 does not stop the feed roller 42 and allows a first sheet 5A fed by the conveying roller pair 44 to rotate the conveying roller 42, reducing wear of the feed roller 42.

As illustrated in FIG. 11, the feed roller 42 rotates backward to feed a second sheet 5B to an upstream from the nip 43A formed between the feed roller 42 and the friction pad 43 in the sheet conveyance direction. Specifically, the feed roller 42 moves the second sheet 5B out of the nip 43A. Even when the second sheet 5B is left for a long time period, a head of the second sheet 5B may not be deformed.

As illustrated in FIGS. 11 and 13, the switch SW or a sensor (not shown) is provided to regulate a stop position at which a head of a second sheet 5B is stopped. For example, the stop position of the head of the second sheet 5B is regulated based on a detection result provided by the switch SW or the sensor. Therefore, the feed roller 42 may feed back the second sheet 5B to the stop position with an increased precision, preventing deformation of the second sheet 5B caused by improper feeding back.

As illustrated in FIG. 13, a head of a second sheet 5B is stopped at a position about 10 mm downstream from the nip 43A formed between the feed roller 42 and the friction pad 43 in the sheet conveyance direction, preventing deformation of the head of the second sheet 5B.

As illustrated in FIG. 15, the conveying belt 31, having an increased attracting force for electrostatically attracting a second sheet 5B, attracts and conveys the second sheet 5B of which head is deformed after being left in the paper tray 41 (depicted in FIG. 1) for a long time period. Thus, the second sheet 5B may not be levitated from the conveying belt 31 and may not slide on the recording heads 24, preventing formation of a faulty image.

As illustrated in FIG. 4, an increased voltage is applied to the charging roller 34 for charging the conveying belt 31 so as to increase an attracting force of the conveying belt 31 for electrostatically attracting a sheet 5. The attracting force of the conveying belt 31 may be effectively increased, preventing formation of a faulty image.

The attracting force of the conveying belt 31 may be increased by decreasing a charging pitch applied to the charging roller 34 for charging the conveying belt 31. The attracting force of the conveying belt 31 may be effectively increased, preventing formation of a faulty image.

As illustrated in FIG. 1, according to the above-described exemplary embodiments, in a sheet feeder (e.g., the paper tray unit 4) including a separating pad (e.g., the friction pad 43), curl of a sheet may be prevented or reduced. In an image forming apparatus (e.g., the image forming apparatus 1) including the sheet feeder, formation of a faulty image due to deformation of a sheet may be prevented in addition to prevention of curl of the sheet.

Numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese patent application No. 2006-322264 filed on Nov. 29, 2006 in the Japan Patent Office, the entire contents of which are hereby incorporated herein by reference.

What is claimed is:

1. A sheet feeder for an image forming apparatus, comprising:

a sheet tray on which is loaded first and second sheets;

a feed roller picking up and feeding the first and second sheets;

a separating pad separating the first sheet from the second sheet, together with the feed roller;

a feed motor driving the feed roller;

a conveying roller pair provided downstream from the feed roller in a sheet conveyance direction, and conveying the first sheet fed by the feed roller; and a deformation prevention member preventing deformation of a head of the second sheet caused by the feed roller and the separating pad nipping the second sheet, wherein when the conveying roller pair nips and conveys the first sheet and a tail of the first sheet is still nipped by the feed roller and the separating pad, the deformation prevention member applies a load to the feed roller to prevent the feed roller from being rotated by the tail of the first sheet nipped and conveyed by the conveying roller pair before the second sheet separated by the feed roller and the separating pad is fed a predetermined distance or greater by the feed roller, the predetermined distance being greater than 0 mm, and wherein the second sheet is prevented from being conveyed to a downstream position downstream from a nip formed between the feed roller and the separating pad, the load applied by the deformation prevention member to the feed roller to prevent the feed roller from being rotated by the tail of the first sheet nipped and conveyed by the conveying roller pair is set to a level that is enough to prevent the second sheet from being conveyed to the downstream position downstream from the nip formed between the feed roller and the separating pad, and the sheet feeder feeds the first sheet followed by the second sheet successively, to a gap between an image forming device of the image forming apparatus and a conveyer of the image forming apparatus, the gap being greater than 0 mm.

2. The sheet feeder according to claim 1, wherein the deformation prevention member stops the feed motor for a predetermined time period after the conveying roller pair nips and feeds the first sheet.

3. The sheet feeder according to claim 2, wherein the deformation prevention member stops the feed motor when the second sheet is a last sheet of sheets continuously fed.

4. The sheet feeder according to claim 3, further comprising a first detector detecting a sheet at a position upstream from the separating pad in the sheet conveyance direction, wherein the deformation prevention member does not stop the feed motor for the last sheet when the first detector detects no sheet following the last sheet.

5. The sheet feeder according to claim 1, wherein the deformation prevention member rotates the feed motor backward to move a head of the second sheet out of the nip formed between the feed roller and the separating pad, after the conveying roller pair nips and feeds the first sheet.

6. The sheet feeder according to claim 5, wherein the deformation prevention member rotates the feed motor backward when the second sheet is a last sheet of sheets continuously fed.

7. The sheet feeder according to claim 6, further comprising a first detector detecting a sheet at a position upstream from the separating pad in the sheet conveyance direction, wherein the deformation prevention member does not rotate the feed motor backward and stops the feed motor for the last sheet when the first detector detects no sheet following the last sheet.

8. The sheet feeder according to claim 7, further comprising a second detector detecting a sheet at a stop position, wherein the deformation prevention member stops the feed motor when the second detector detects that the second sheet reaches the stop position.

9. The sheet feeder according to claim 5, wherein the deformation prevention member rotates the feed motor backward when a predetermined time period elapses after the feed roller and the separating pad separate the first sheet from the second sheet and feed the first sheet.

10. The sheet feeder according to claim 1, wherein the deformation prevention member stops a head of the second sheet at a predetermined distance downstream from the nip formed between the feed roller and the separating pad in the sheet conveyance direction.

11. The sheet feeder according to claim 10, wherein the predetermined distance is approximately 10 mm.

12. The sheet feeder according to claim 10, further comprising a second detector detecting a sheet at a stop position, wherein the deformation prevention member stops the feed motor when the second detector detects that the second sheet reaches the stop position.

13. The sheet feeder according to claim 1, wherein the separating pad is fixed in the sheet feeder and does not move or rotate.

14. An image forming apparatus, comprising:

a sheet feeder configured to feed a sheet, and comprising a sheet tray on which is loaded first and second sheets;

a feed roller picking up and feeding the first and second sheets;

a separating pad separating the first sheet from the second sheet, together with the feed roller;

a feed motor driving the feed roller;

a conveyer conveying the sheet fed by the sheet feeder, the conveyer including a conveying roller pair provided downstream from the feed roller in a sheet conveyance direction, and conveying the first sheet fed by the feed roller; and a deformation prevention member preventing deformation of a head of the second sheet, caused by the feed roller and the separating pad nipping the second sheet; and an image forming device forming an image on the sheet conveyed by the conveyer, wherein when the conveying roller pair nips and conveys the first sheet and a tail of the first sheet is still nipped by the feed roller and the separating pad, the deformation prevention member applies a load to the feed roller to prevent the feed roller from being rotated by the tail of the first sheet nipped and conveyed by the conveying roller pair before the second sheet separated by the feed roller and the separating pad is fed a predetermined distance or greater by the feed roller, the predetermined distance being greater than 0 mm, and wherein the second sheet is prevented from being conveyed to a downstream position downstream from a nip formed between the feed roller and the separating pad, the load applied by the deformation prevention member to the feed roller to prevent the feed roller from being rotated by the tail of the first sheet nipped and conveyed by the conveying roller pair is set to a level that is enough to prevent the second sheet from being conveyed to the downstream position downstream from the nip formed between the feed roller and the separating pad, and the sheet feeder feeds the first sheet followed by the second sheet successively, to a gap between the image forming device and the conveyer, the gap being greater than 0 mm.

15. The image forming apparatus according to claim 14, further comprising:

a conveyer configured to convey the sheet sent by the sheet feeder, the conveyer comprising a conveying belt configured to electrostatically attract and convey the sheet;

a recording head configured to discharge a liquid drop onto the sheet conveyed by the conveyer to form an image on the sheet; and a controller configured to control operation of the image forming apparatus, wherein the controller increases an attracting force of the conveying belt for attracting the sheet when an interval between conveyance of successive sheets exceeds a predetermined time period.

16. The image forming apparatus according to claim 15, wherein:

the conveyer further comprises a charger configured to charge the conveying belt; and an increased voltage is applied to the charger to increase the attracting force of the conveying belt.

17. The image forming apparatus according to claim 16, wherein a decreased charging pitch is applied to the charger to increase the attracting force of the conveying belt.

18. The image forming apparatus according to claim 15, wherein:

the conveyer further comprises a charger configured to charge the conveying belt; and a decreased charging pitch is applied to the charger to increase the attracting force of the conveying belt.

19. A sheet feeding method, comprising:

receiving, by a sheet feeder, sheets including first and second sheets;

driving a feed roller of the sheet feeder with a feed motor;

picking up and feeding the first and second sheets with the feed roller;

separating the first sheet from the second sheet with the feed roller and a separating pad;

conveying, by a conveyer including a conveying roller pair provided downstream from the feed roller in a sheet conveyance direction, the sheet fed by the sheet feeder, including conveying, by the conveying roller pair, the first sheet fed by the feed roller; and stopping the feed motor to prevent deformation of a head of the second sheet caused by the feed roller and the separating pad nipping the second sheet, wherein when the conveying roller pair nips and conveys the first sheet and a tail of the first sheet is still nipped by the feed roller and the separating pad, a deformation prevention member applies a load to the feed roller to prevent the feed roller from being rotated by the tail of the first sheet nipped and conveyed by the conveying roller pair before the second sheet separated by the feed roller and the separating pad is fed a predetermined distance or greater by the feed roller, the predetermined distance being greater than 0 mm, and wherein the second sheet is prevented from being conveyed to a downstream position downstream from a nip formed between the feed roller and the separating pad, the load applied by the deformation prevention member to the feed roller to prevent the feed roller from being rotated by the tail of the first sheet nipped and conveyed by the conveying roller pair is set to a level that is enough to prevent the second sheet from being conveyed to the downstream position downstream from the nip formed between the feed roller and the separating pad, and the sheet feeder feeds the first sheet followed by the second sheet successively, to a gap between an image forming device and a conveyer, the gap being greater than 0 mm.

* * * * *